US009857721B2

(12) United States Patent
Yamaya et al.

(10) Patent No.: US 9,857,721 B2
(45) Date of Patent: Jan. 2, 2018

(54) LIGHT SOURCE DEVICE, OPTICAL SCANNING APPARATUS AND IMAGE FORMING APPARATUS

(71) Applicant: CANON KABUSHIKI KAISHA, Tokyo (JP)

(72) Inventors: Fumihiko Yamaya, Mishima (JP); Yoshihiko Tanaka, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/261,484

(22) Filed: Sep. 9, 2016

(65) Prior Publication Data

US 2017/0075251 A1 Mar. 16, 2017

(30) Foreign Application Priority Data

Sep. 15, 2015 (JP) ..... 2015-181678

(51) Int. Cl.
*G03G 15/00* (2006.01)
*G03G 15/04* (2006.01)

(52) U.S. Cl.
CPC ... *G03G 15/04036* (2013.01); *G03G 15/0409* (2013.01)

(58) Field of Classification Search
CPC ..... G03G 15/0409; G03G 15/04036
See application file for complete search history.

(56) References Cited

U.S. PATENT DOCUMENTS

| | | | | |
|---|---|---|---|---|
| 5,003,614 | A | 3/1991 | Tanaka et al. | 382/18 |
| 6,856,338 | B2 | 2/2005 | Takahashi et al. | 347/225 |
| 6,928,100 | B2 | 8/2005 | Sato et al. | 372/109 |
| 6,969,846 | B2 | 11/2005 | Tanaka et al. | 250/239 |
| 7,508,859 | B2 | 3/2009 | Azami et al. | 372/101 |
| 8,355,192 | B2 | 1/2013 | Obara | 359/204.1 |
| 8,681,405 | B2 | 3/2014 | Obara | 359/204.1 |
| 8,717,656 | B2 | 5/2014 | Shimizu et al. | B41J 2/471 |
| 8,786,927 | B2 | 7/2014 | Obara | G02B 26/123 |
| 8,911,112 | B2 | 12/2014 | Takamatsu et al. | G02B 26/124 |
| 9,128,291 | B2 | 9/2015 | Nagatoshi et al. | G02B 26/121 |
| 2002/0075916 | A1* | 6/2002 | Sato | G02B 7/025 372/36 |

(Continued)

FOREIGN PATENT DOCUMENTS

| | | |
|---|---|---|
| JP | H7-159663 | 6/1995 |
| JP | 2002-244062 | 8/2002 |

(Continued)

OTHER PUBLICATIONS

U.S. Appl. No. 15/262,962, filed Sep. 12, 2016.

*Primary Examiner* — David M Gray
*Assistant Examiner* — Michael Harrison
(74) *Attorney, Agent, or Firm* — Fitzpatrick, Cella, Harper & Scinto

(57) ABSTRACT

A light source device includes a light source configured to emit a laser beam; a lens through which the laser beam emitted from the light source passes; and a holder member for holding the light source and the lens; wherein the holder member is provided with an opening through which the laser beam is outputted; wherein the lens is bonded with the holder member at whole circumference of the opening by an adhesive material without contact with the holder member.

8 Claims, 8 Drawing Sheets

(56) References Cited

U.S. PATENT DOCUMENTS

| | | | | |
|---|---|---|---|---|
| 2015/0338768 | A1 | 11/2015 | Nagatoshi et al. .. | G03G 15/043 |
| 2016/0131896 | A1 | 5/2016 | Nakamura et al. .. | G02B 26/121 |

FOREIGN PATENT DOCUMENTS

| | | |
|---|---|---|
| JP | 2003-098413 | 4/2003 |
| JP | 2003-98464 | 4/2003 |
| JP | 2004-163607 | 6/2004 |
| JP | 2007-286386 | 11/2007 |
| JP | 2010-72185 | 4/2010 |
| JP | 2012-155100 | 8/2012 |

* cited by examiner (a)

(b)

(a)

(b)

(a)

(b)

(a)

(b)

(a)

(b)

LIGHT SOURCE DEVICE, OPTICAL SCANNING APPARATUS AND IMAGE FORMING APPARATUS

FIELD OF THE INVENTION AND RELATED ART

The present invention relates to a light source device which emits a beam of laser light. It relates also to an optical scanning apparatus equipped with a light source device, and an image forming apparatus equipped with the optical scanning apparatus.

Part (a) of FIG. 8 is a perspective view of a light source which emits a beam of laser light, and part (b) of FIG. 8 is a sectional view of the light source device. A beam of laser light emitted from a laser S is converted into a parallel beam by a collimator lens C. The laser S internally holds an unshown laser light emitting element. It is held to a holder F by a stem P, which is a flange portion pressed into a cylindrical portion H of the holder F.

There have been proposed various methods for fixing a collimator lens to a light source device such as the above-described one. For example, Japanese Laid-open Patent Application No. 2002-244062 discloses one of such methods. According to this patent application, a collimator lens is adjusted in position in terms of its radius direction in order to adjust its optical axis in position. Next, the collimator lens is adjusted in position in terms of the direction parallel to its optical axis. Then, it is fixed to the holder with the use of adhesive. According to Japanese Laid-open Patent Application No. 2003-98413, a collimator lens is placed in contact with a holder by being moved in the direction parallel to its optical axis. Then, it is fixed to the holder with the use of photo-curable adhesive.

The stem portion of a laser is likely to be provided with recesses, because of such a reason that it has to be manipulated during laser manufacturing, or the like reason (FIG. 4). In a case of the laser, disclosed in Japanese Laid-open Patent Application No. 2002-244062, which uses a stem portion having recesses, the recesses leave gaps between the holder and the laser.

Further, with regard to a collimator lens, a gap is provided as an adjustment clearance, between the collimator lens and holder, in order to adjust the collimator lens in position as described above. In other words, a light source device has two types of opening, that is, the opening left by the recess of the stem portion of the laser, between the stem portion of the laser and the holder, and the opening between the holder and collimator lens. These openings can function as an air entrance or an air exit, making it likely for an air flow to be created in the light source device.

If an air flow exists in a light source device, it is possible that foreign substances will enter the apparatus from outside the apparatus, and adhere to the portion of the apparatus, though which a beam of laser light is projected outward from the apparatus. If the foreign substances adhere to the portion of the light source device, through which a beam of laser light is projected outward from the apparatus, it is possible that the beam is partially, or even completely blocked, making it possible that the beam emitted from the light source device will be insufficient in intensity, and therefore, image defects will occur. In particular, a beam of laser light emitted from a laser is highly focused. Therefore, even if the foreign substances having adhered to the portion of the light source device is very small, their ill effects are substantial.

As for the types of foreign substance which will possibly enter a light source device from outside the apparatus, they are likely to be dust particles in the ambient air. Moreover, various types of laser beam printer are structured to draw the ambient air into themselves with the use of a fan in order to cool their internal components, making it possible for the dust particles to be floating in the adjacencies of their optical scanning apparatus. Therefore, if there is an air flow in a light source device, the dust particles carried by the air flow are likely to adhere to the laser.

In recent years, in order to reduce a laser in cost, development of a glass-less laser, that is, a laser which does not have a sealing glass, has been going on. In a case of a glass-less laser, the laser light emitting element (which will have been shielded from ambient air in conventional laser) is exposed to the ambient air. The portion of a laser light emitting element, from which laser light is emitted, is extremely small, being roughly several micrometers in size. Therefore, a glass-less laser is greater than a laser having a sealing glass, in terms of a risk that image defects will occur due to the foreign substance adhesion.

In the case of a laser structured like the one disclosed in Japanese Laid-open Patent Application No. 2003-98413, a collimator lens is placed in contact with the holder by being moved in the direction parallel to its optical axis, and then, is adhered to the holder with the use of adhesive. Therefore, there is no gap between the collimator lens and holder. In this case, therefore, the laser is moved in the direction parallel to its optical axis to focus the light source device.

Here, in a case where a laser is pressed into the cylindrical portion of the holder, it is basically only the direction in which the laser is pressed into the cylindrical portion of the holder that the laser can be moved, for the following reason. That is, it is possible that when the laser is pressed into the holder, the holder will be shaved, and/or deformed, by the laser. Therefore, if the laser is moved in the opposite direction from the direction in which it was pressed into the holder, it is possible that the laser will fail to remain securely held to the holder.

In this case, the final laser position may be the designated position, that is, where the laser is supposed to be by design, or offset by an amount corresponding to the abovementioned adjustment. Therefore, it is possible that the light source device will not be highly accurately focused, in consideration of the tolerance in the dimension of various components of the apparatus.

SUMMARY OF THE INVENTION

The present invention was made in consideration of the present state of the development of a glass-less laser. Therefore, the primary object of the present invention is to provide a light source device which is capable of reducing an image forming apparatus in the amount of image defects attributable to the adhesion of foreign substances to a laser, without being reduced in the accuracy with which the beam of laser light emitted from the laser is focused.

According to an aspect of the present invention, there is provided a light source device comprising a light source configured to emit a laser beam; a lens through which the laser beam emitted from said light source passes; and a holder member for holding said light source and said lens; wherein said holder member is provided with an opening through which the laser beam is outputted; wherein said lens is bonded with said holder member at whole circumference of said opening by an adhesive material without contact with said holder member.

Further features of the present invention will become apparent from the following description of exemplary embodiments with reference to the attached drawings.

DESCRIPTION OF THE EMBODIMENTS (Embodiment 1)

<Image Forming Apparatus>

To begin with, the image forming apparatus A in the first embodiment of the present invention is described about its overall structure, along with its image forming operation, with reference to appended drawings.

Figure 1:
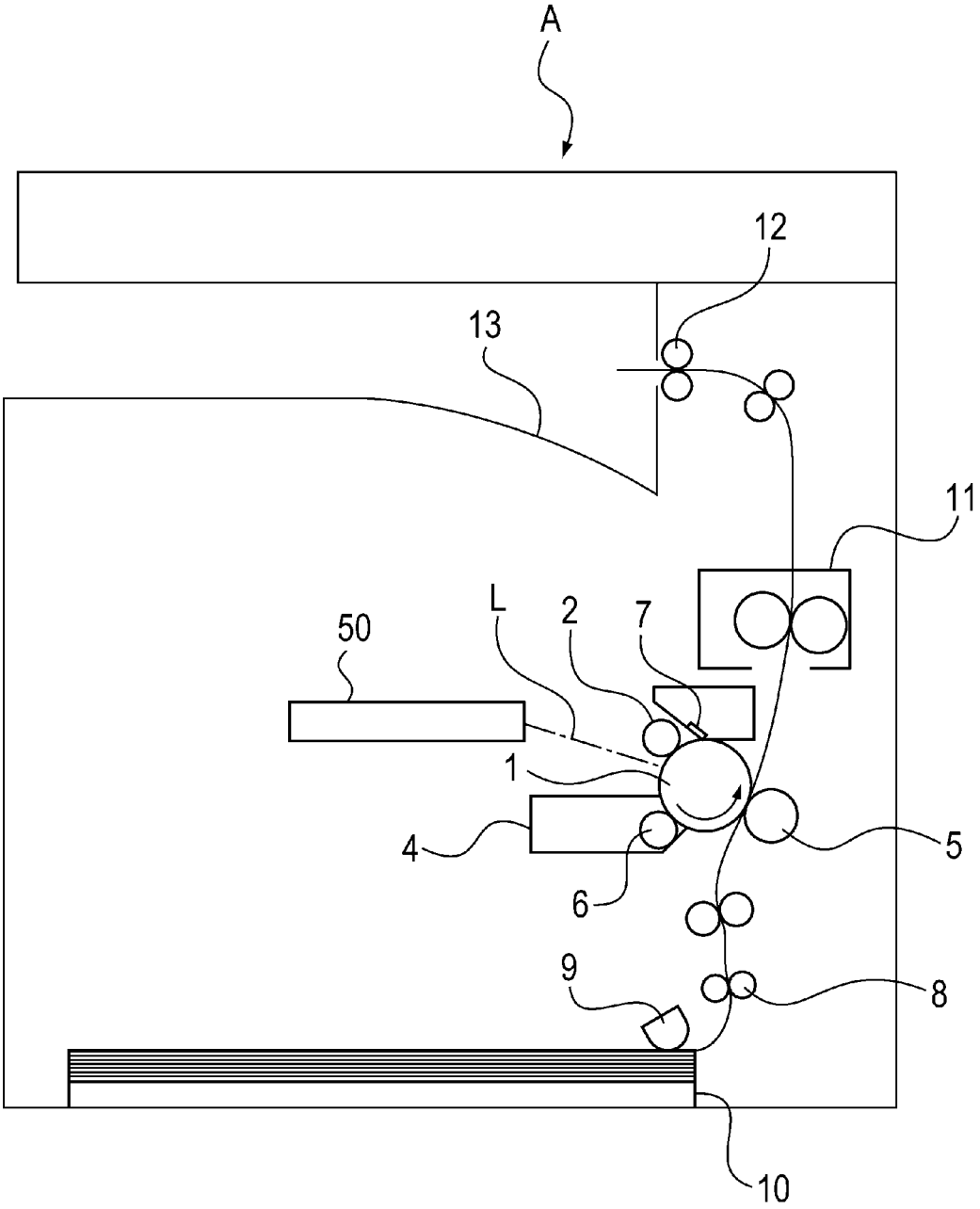
FIG. 1 is a schematic sectional view of an image forming apparatus.

Referring to FIG. 1, the image forming apparatus A has: an image forming portion which transfers a toner image onto a sheet of recording medium; a sheet conveying portion which supplies the image forming portion with a sheet of recording medium; and a fixing portion which fixes the toner image to the sheet.

The image forming portion has a photosensitive drum 1 (image bearing member), a charge roller 2, an optical scanning apparatus 50, a developing device 4, a transfer roller 5, etc.

In an image forming operation, as an unshown controlling portion of the image forming apparatus A outputs a print signal, one of the sheets of recording medium stored in layers in a sheet storing portion 10 is sent to the image forming portion by a combination of a sheet feeder roller 9 and a sheet conveyance roller 8.

Meanwhile in the image forming portion, charge bias is applied to the charge roller 2, whereby the peripheral surface of the photosensitive drum 1, which is in contact with the charge roller 2, is charged. Next, a beam of laser light is projected from a semiconductor laser 113 (light source), which a light source device 100, shown in FIG. 3, internally holds, while being modulated according to the image information obtained by the optical scanning apparatus 50 (scanning means) from an unshown image reading portion, or the like, in a manner to scan (expose) the peripheral surface of the photosensitive drum 1. Thus, exposed points of the peripheral surface of the photosensitive drum 1 reduce in potential. Consequently, an electrostatic image which reflects the image information, is effected on the peripheral surface of the photosensitive drum 1.

Then, development bias is applied to the development sleeve 6, with which the developing device 4 is provided. Thus, toner (developer) is adhered to the electrostatic latent image formed on the peripheral surface of the photosensitive drum 1. As a result, a toner image is formed on the peripheral surface of the photosensitive drum 1. Then, the toner image is sent into a transfer nip, which is the area of contact between the photosensitive drum 1 and transfer roller 5. As the toner image arrives at the transfer nip, transfer bias, which is opposite in polarity from the toner, is applied to the transfer roller 5. Consequently, the toner image is transferred onto a sheet of recording medium.

After the transfer of the toner image onto a sheet of recording medium, the sheet is sent to the fixing device 11, and is conveyed through the fixation nip, which is the area of contact between the heating portion and pressure applying portion of the fixing device 11. While the sheet is conveyed through the fixation nip, the sheet and the toner image thereon are heated and pressed. Consequently, the toner image is fixed to the sheet. Then, the sheet is conveyed further, and is discharged into a delivery tray 13 by a pair of discharge rollers 12.

<Optical Scanning Device>

Figure 2:
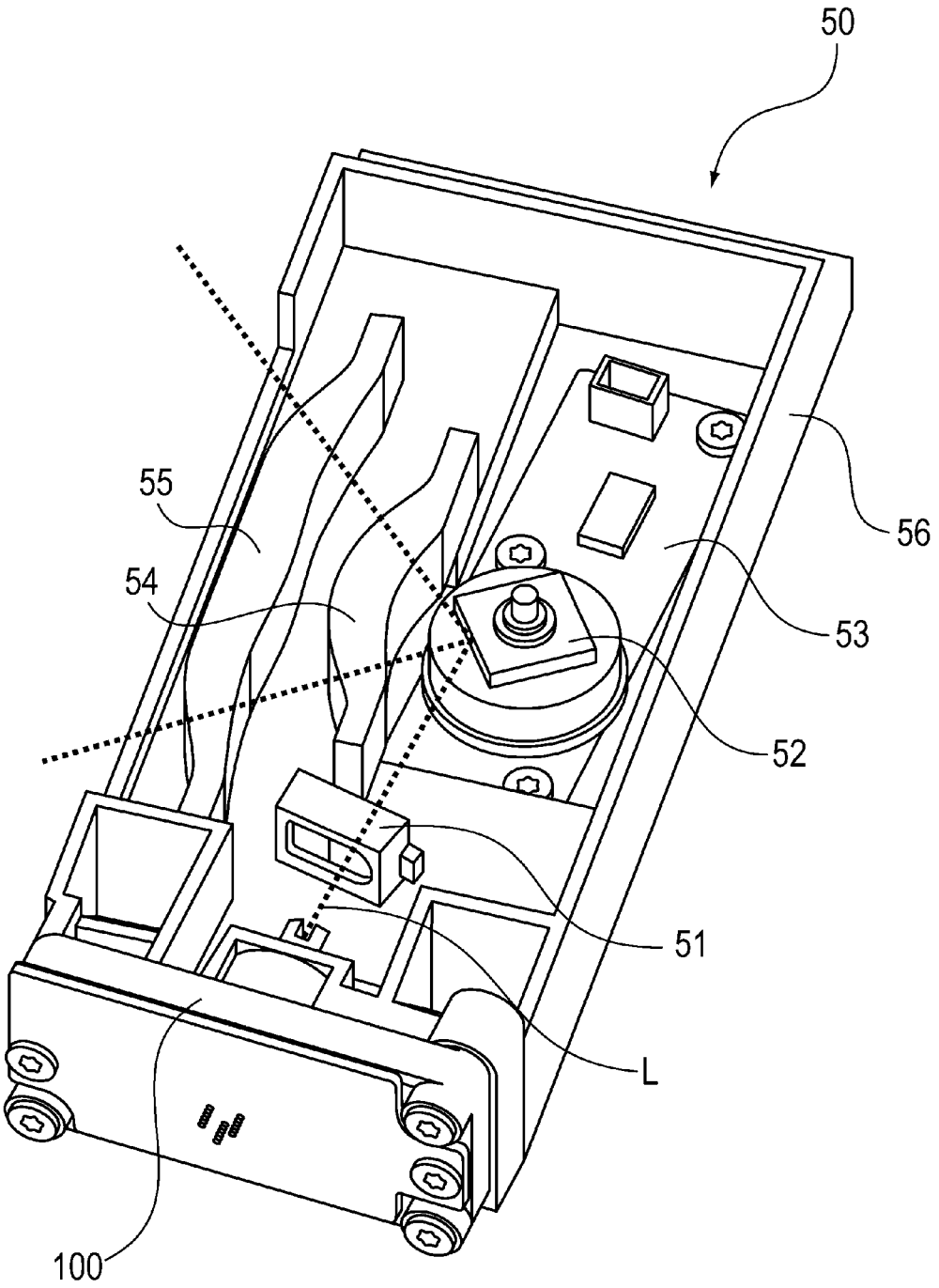
FIG. 2 is a perspective view of a light source device.

Next, the optical scanning apparatus 50 is described about its structure. Referring to FIG. 2, the optical scanning apparatus 50 has: a light source device 100, a cylindrical lens 51, a rotational polygonal mirror 52, a motor driving circuit board 53, a pair of f-θ lenses 54 and 55, and a casing 56, in which the preceding members are disposed.

As a beam L of laser light is emitted from the semiconductor laser 113 in the optical scanning apparatus 100, it is condensed by the cylindrical lens 51 in terms of only the secondary scan direction, and then, is condensed in a manner to form a long line across the reflective surfaces of the rotational polygonal mirror 52.

The rotation of the rotational polygonal mirror 52 is controlled by the motor driving circuit board 53, so that as the beam L of laser light hits the rotational polygonal mirror 52, it is deflected by the mirror 52 in a manner to scan the peripheral surface of the photosensitive drum 1. There, the deflected beam L of laser light travels through the f-θ lenses 54 and 55, and scans the peripheral surface of the photosensitive drum 1, while remaining focused on the peripheral surface of the photosensitive drum 1.

By the way, the top opening of the casing 56 is covered by an unshown resinous or metallic lid.

<Light Source Device>

Figure 3:
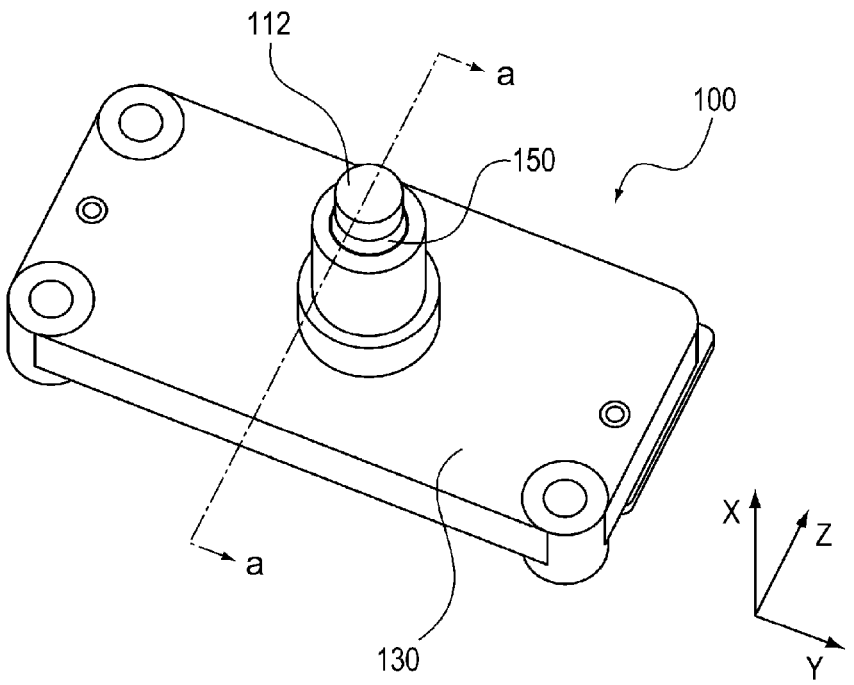
FIG. 3 is a combination of perspective and sectional views of the light source device.
Figure 3:
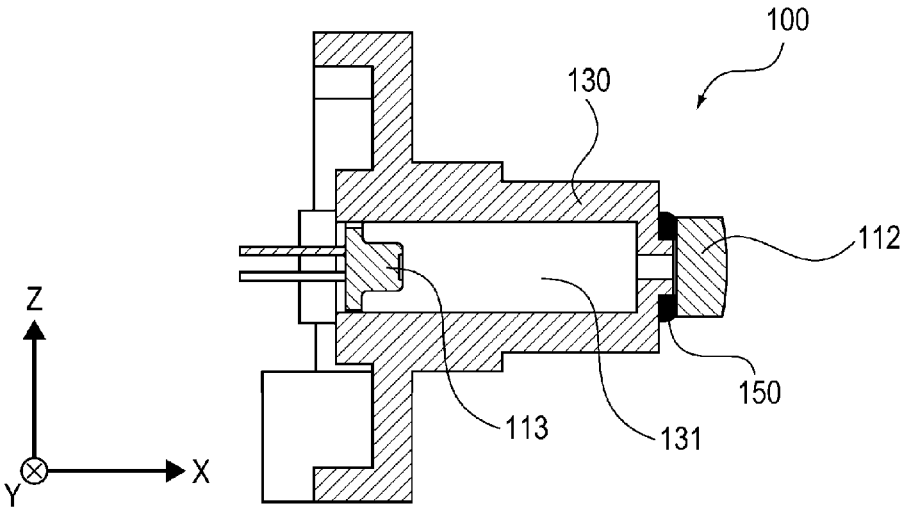

Next, the light source device 100 is described in detail about its structure. Part (a) of FIG. 3 is a perspective view of the light source device 100. Part (b) of FIG. 3 is a sectional view of the light source device 100 at a plane a-a in part (a) of FIG. 3. As is evident from FIG. 3, the light source device 100 has a holder 130, a collimator lens 112, etc.

Referring to part (b) of FIG. 3, the holder 130 has a cylindrical portion 131, which holds the semiconductor laser 113 by one of its lengthwise ends. The other end of the cylindrical portion 131 has an opening through which the beam L of laser light is projected outward from the light source device 100. It is in the adjacencies of this opening that the collimator lens 112 is held to the holder 130. By the way, in this embodiment, the semiconductor laser 113 is held to the holder 130 by being pressed into the holder 130. However, the semiconductor laser 113 may be held to the holder 130 by a method other than being pressed into the holder 130.

Figure 4:
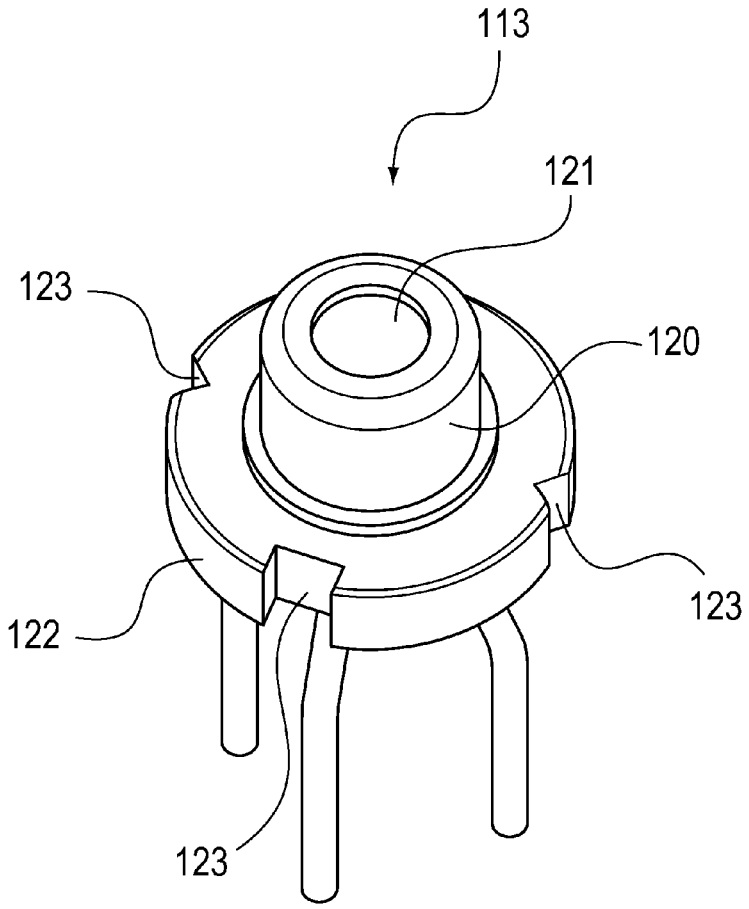
FIG. 4 is a perspective view of a laser.

The semiconductor laser 113 emits a beam of laser light by being driven by an unshown circuit board. Regarding the structure of this semiconductor laser 113, an unshown laser chip, which is a laser light emitting element, is supported by a stem 122, which is the cylindrical flange portion of the metallic holder, by being mounted on the stem 122, as shown in FIG. 4. It is covered with a cap 120, which is provided with a hole 121 though which the beam L of laser light is projected outward of the semiconductor laser 113. By the way, the cap 120 may be structured so that a sealing glass can be inserted into the hole 121 to seal the cap 120. In this embodiment, however, the cap 120 is not provided with the sealing glass, in order to reduce the semiconductor laser 113 in cost. In other words, the laser in this embodiment is a glass-less laser, that is, a laser which does not have the sealing glass. Therefore, the laser chip is exposed to the ambient air.

Further, the peripheral portion of the stem 122, in terms of its radius direction, is provided with recesses 123, which are used to manipulate the stem 122 during the manufacturing of the light source device 100. For example, the recesses 123 are used to grasp the semiconductor laser 113, and/or to precisely position the stem 122 in terms of the circumferential direction of the stem 122 when the laser chip is mounted on the step 122. The stem 122 which has the recesses 123 as described above has such a shape that is often seen among ordinary semiconductor laser, and is mass-produced. Therefore, using such a stem as the stem 122 makes it possible to reduce the light source device 100 in cost.

The collimator lens 112 converts the beam of laser light projected by the semiconductor laser 113, into a parallel beam of laser light, or a beam of laser light which converges or diverges in a preset manner. This collimator lens 112 is held to the holder 130 by being attached to the holder with the use of adhesive 150. By the way, in this embodiment, photo-curable adhesive is used as the adhesive 150. Thus, the photo-curable adhesive is illuminated with the light for curing the photo-curable adhesive, in order to fix the collimator lens 112 to the holder 130.

<Structure of Portion of Holder, to which Collimator Lens is Adhered>

Next, the portion of the holder 130, to which the collimator lens 112 is fixed with the use of adhesive, is described in detail about its structure.

Figure 5:
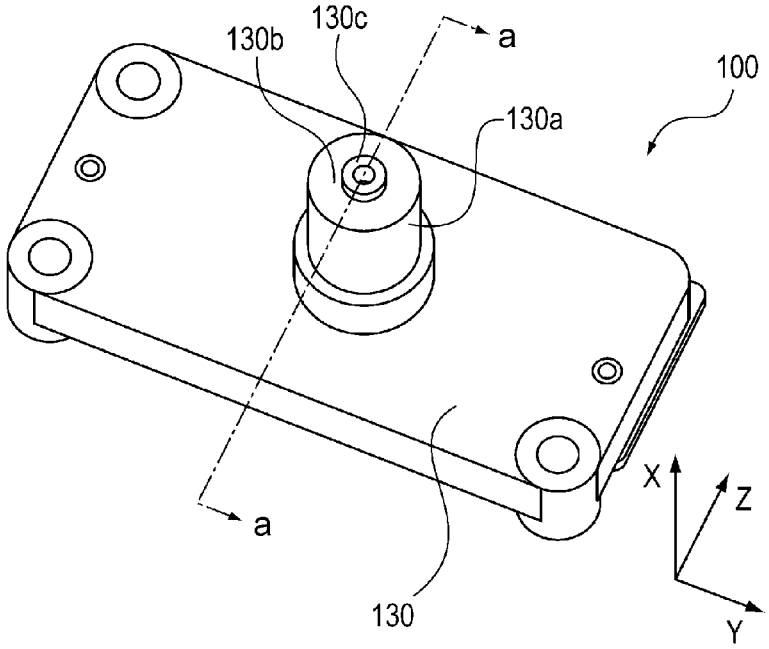
FIG. 5 is a drawing for describing the structure of the portion of the holder of the light source device in the first embodiment, to which a collimator lens is adhered.
Figure 5:
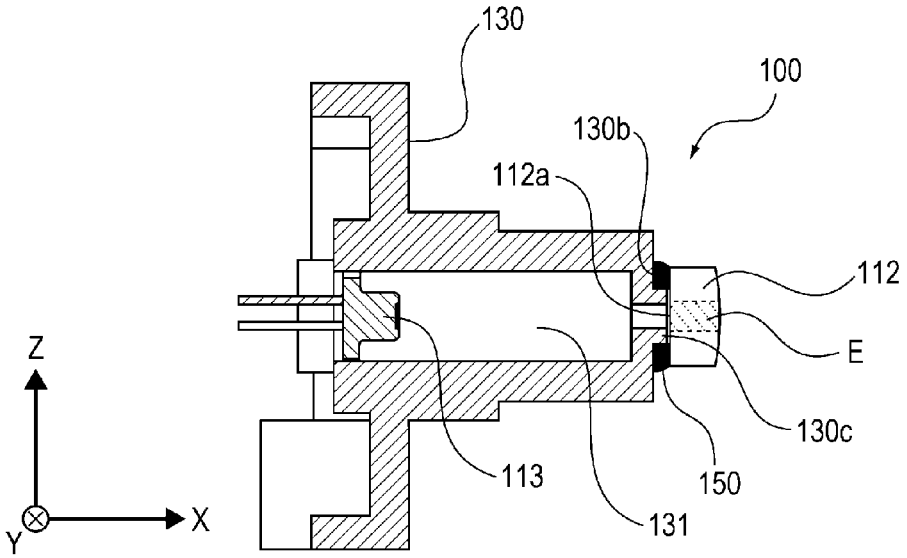

Part (a) of FIG. 5 is a perspective view of the holder 130. Part (b) of FIG. 5 is a sectional view of the holder 130 at a plane a-a in part (a) of FIG. 5. By the way, part (a) of FIG. 5 is a drawing of the holder 130 prior to the fixation of the collimator lens 112 to the holder 130 with the use of the adhesive, whereas part (b) of FIG. 5 is a drawing of the holder 130 after the adhesion of the collimator lens 112 to the holder 130.

Referring to part (a) of FIG. 5, the holder 130 has a main portion 130*a* having the cylindrical portion 131. It has also an adhesive application surface 130*b*, which opposes the laser light entry surface 112*a* of the collimator lens 112, through which the laser light enters the collimator lens 112. Further, the holder 130 has a cylindrical protrusion 130*c*, which protrudes outward from the adhesive application surface 130*b* in the direction parallel to the optical axis of the collimator lens 112.

The method for attaching the collimator lens 112 to the holder 130 with the use of adhesive is as follows: First, the adhesive 150 is applied to the cylindrical portion 130*c* across the entirety of its peripheral surface. That is, the adhesive 150 is applied to the adhesive application surface 130*b*, which is on the outward side of the protrusive portion 130*c*, in terms of the radius direction of the aforementioned opening, through which the beam of laser light projected outward. As the adhesive 150 is applied, it is made by its surface tension to form such a shape that its surface bulges outward of the holder 130, in curvature, beyond the top surface of the cylindrical protrusion 130*c*, in the direction (axis X) parallel to the optical axis of collimator lens 112.

Next, the collimator lens 112 is positioned so that its laser light entry surface 112*a* contacts the adhesive 150. During this process, it has to be ensured that the laser light entry surface 112*a* of the collimator lens 112 does not come into contact with the holder 130.

Then, the collimator lens 112 is adjusted in its position relative to the semiconductor laser 113. More concretely, the collimator lens 112 is moved in the direction parallel to the axis X, that is, the direction parallel to the optical axis of the collimator lens 112, to focus the beam L of laser light. Further, it is moved in the direction parallel to the axes Z and Y, that is, the direction parallel to the radius direction of the collimator lens 112, to adjust the beam L of laser light in the position of its optical axis. By the way, as the collimator lens 112 is placed in contact with the adhesive 150, the adhesive 150 wets the laser light entry surface 112*a*. Thus, even if the collimator lens 112 is moved in the direction to separate the collimator lens 112 from the holder 130 for the purpose of focusing, the collimator lens 112 is prevented from contacting the holder 130, by the surface tension of the adhesive 150.

After the completion of the positional adjustment of the collimator lens 112, the adhesive 150 is illuminated with the light for curing the adhesive 150, to harden the adhesive 150 in order to fix the collimator lens 112 to the holder 130.

Because the adhesive 150 is applied to the adhesive application surface 130*b* of the holder 130, across the entirety of the adhesive application surface 130*b*, in terms of the circumferential direction of the opening of the cylindrical portion 131, as described above, in order to fix the collimator lens 112 to the holder 130, the gap between the holder 130 and the peripheral portion of the collimator lens 112 is filled with the adhesive 150. Thus, the only openings which connect between the outside and inside of the cylindrical portion 131 are the gaps left between the cylindrical portion 131 and the stem 122 by the recesses with which the stem 122 is provided. Therefore, it is unlikely for an air flow to occur between the outside and inside of the cylindrical portion 131 of the holder 130. Therefore, it is possible to reduce the risk that dust particles or the like enter the cylindrical portion 131 of the light source device 100, and cause image defects by adhering to the semiconductor laser 113.

Also as described above, the collimator lens 112 is adhered to the holder 130 with no direct contact between the laser light entry surface 112*a* of the collimator lens 112, and the holder 130. Therefore, it is possible to move the collimator lens 112 not only in the direction parallel to the axes Y and Z, but also, in the outward or inward direction of the holder 130 in the direction (of axis X) parallel to the optical axis of the beam of laser light. Therefore, it is possible to highly precisely focus the beam of laser light, and also, to highly precisely adjust the light source device 100 in the position of the optical axis of the collimator lens 112, without moving the semiconductor laser 113.

Further, the holder 130 is provided with the adhesive controlling portion 130*c* (protrusive cylindrical portion), which has a preset height relative to the adhesive application surface 130*b*, in terms of the direction (parallel to axis X) parallel to the optical axis of the beam of laser light, and which is greater in diameter than a preset value. Therefore, it is possible to prevent the adhesive 150 from invading into the light path area E of the collimator lens 112.

(First Example of Modification)

Next, a light source device 200, which is the first modified version of the light source device 100 in the above-described first embodiment of the present invention, is described about its structure. The portions of light source device 200, which are the same in description as the counterparts of the light source device 100 in the first embodiment, are given the same referential codes as those given to the counterparts, and are not described here. The light source device 200, or the first modified version of the light source device 100 in the first embodiment, is the same in structure as the light source device 100, except that the holder 230 of the light source device 200 is different in shape from the holder 130 of the light source device 100.

Figure 6:
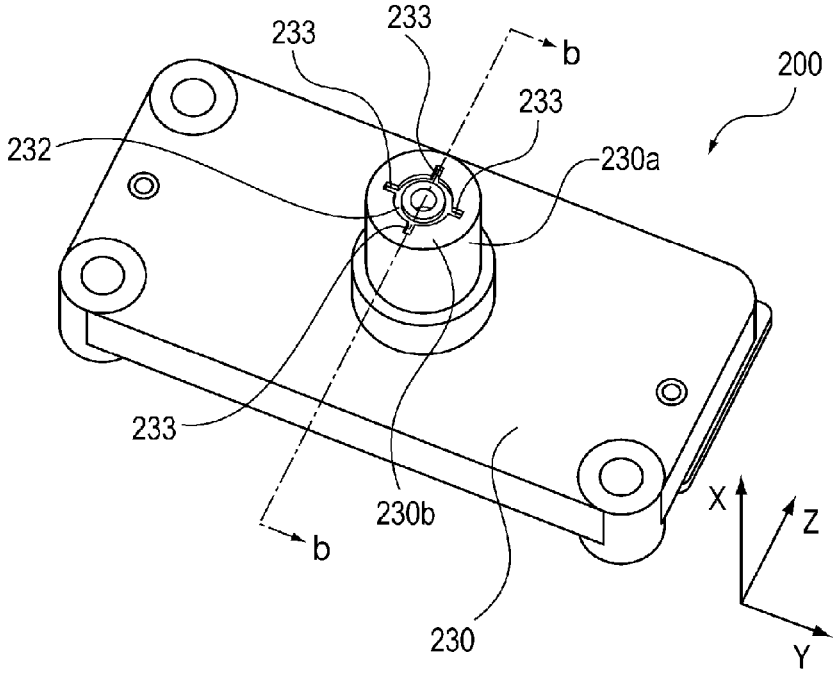
FIG. 6 is a drawing for describing the structure of the portion of the holder of the first modified version of the light source device in the first embodiment, to which a collimator lens is adhered.
Figure 6:
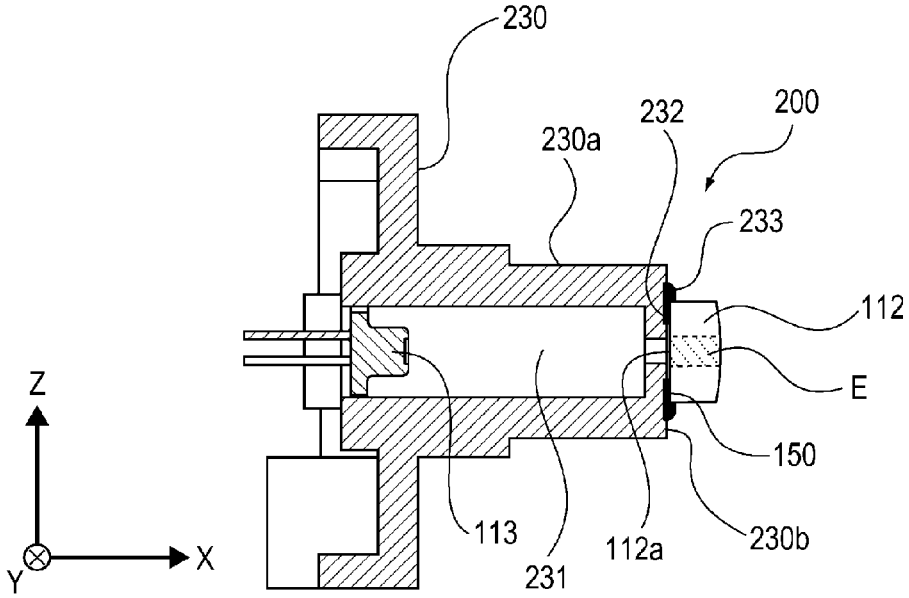

Part (a) of FIG. 6 is a perspective view of a holder 230, which is the first modified version of the holder 130 in the first embodiment. Part (b) of FIG. 6 is a sectional view of the holder 230 at a plane b-b in part (a) of FIG. 6. By the way, part (a) of FIG. 6 shows the holder 230 prior to the attachment of the collimator lens 112 to the holder 230 with the use of adhesive, whereas part (b) of FIG. 6 shows the light source device 200 after the attachment of the collimator lens 112 to the holder 230 with the use of adhesive, for the sake of making it easier to describe the holder 230.

Referring to part (a) of FIG. 6, the holder 230 has: a main portion 230*a* which has a cylindrical portion 231; and an adhesive application surface 230*b*, which opposes the laser light entry surface 112*a* of the collimator lens 112. The adhesive application surface 230*b* has a groove 232 (circular groove), which is to be filled with adhesive 150; and escape grooves 233 (which are in connection to circular groove 232, and are inter-sectional to circular groove 232), into which an excessive amount of adhesive is allowed to escape.

The method used to attach the collimator lens 112 to the holder 230 with the use of adhesive is as follows: First, the groove 232 is filled with adhesive 150, and then, the collimator lens 112 is positioned so that its laser light entry surface 112*a* is placed in contact with the adhesive 150, while preventing the laser light entry surface 112*a* of the collimator lens 112 from directly coming into contact with the holder 230.

With the use of this method, the collimator lens 112 is adhered to the adhesive 150 in the groove 232, across the entirety of its circumferential direction. Therefore, no gap is left between the holder 230 and collimator lens 112. Therefore, only openings which connect the outside of the holder 230 and the internal space of the cylindrical portion 231 of the holder 230 are the gaps left between the holder 230 and the stem 122 of the semiconductor laser 113 by the recesses 123 of the stem 122. Therefore, it is unlikely for an air flow to occur between the ambient air of the holder 230 and the internal space of the cylindrical portion 231 of the holder 230. Therefore, the holder 230 can reduce the risk that dust particles and the like enter the cylindrical internal space of the holder 230, and cause image defects by adhering to the semiconductor laser 113.

Further, the collimator lens 112 is adhered to the holder 230 with no direct contact between the laser light entry surface 112*a* of the collimator lens 112 and the holder 230. Therefore, the collimator lens 112 can be moved not only in the direction parallel to the axes Y and Z, but also, in the direction parallel to the optical axis of the beam of laser light (direction parallel to axis X). Therefore, it is possible to highly precisely focus the beam of laser light, and also, to highly precisely adjust the optical axis in position, without moving the semiconductor laser 113.

Further, as the collimator lens 112 is placed in contact with the adhesive 150, an excessive amount of the adhesive 150 filled in the groove 232 naturally oozes (escapes) into the escape groove 233. Therefore, it is possible to prevent the adhesive 150 from invading into the light path area E of the collimator lens 112.

By the way, in the case of this holder 230, or the first modified version of the holder 130 in the first embodiment, the groove 232 is made circular, and is provided with multiple escapes (sub-grooves). However, this modification is not intended to limit the presence invention in scope. For example, the adhesive 150 can be prevented from invading (oozing) into the light path area E of the collimator lens 112, by providing the holder 230 with the circular groove 232, and at least one adhesive escape groove 233 which extends in the radius direction of the adhesive application surface 230*b*.

Further, the holder 130 in the first embodiment may be modified so that its adhesive application surface 130*b* is provided with an adhesive holding groove, and adhesive escape grooves, such as those of the holder 230, that is, the first modified version of the holder 130 in the first embodiment. With such modification, it is possible to enhance the first embodiment in its effect of preventing the adhesive 150 from invading (oozing) into the light path area E of the collimator lens 112.

(Second Example of Modification)

Next, a light source device 300, which is the second version of the modification of the light source device 100 in the first embodiment. The portions of the light source device 300, which are the same in description as the counterparts of the light source device 100 in the first embodiment, are given the same referential codes as those given to the counterparts, and are not described here. The light source device 300, or the second version of the modification of the light source device 100 in the first embodiment, is the same in structure as the light source device 100, except that the holder 330 of the light source device 300 is different in shape from the holder 130 in the first embodiment.

Figure 7:
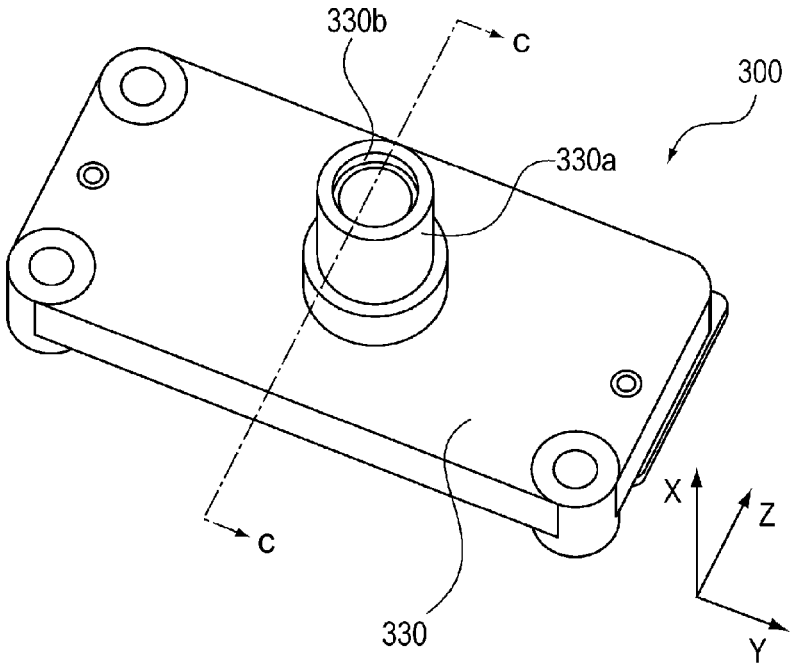
FIG. 7 is a drawing for describing the structure of the portion of the holder of the second modified version of the light source device in the first embodiment.
Figure 7:
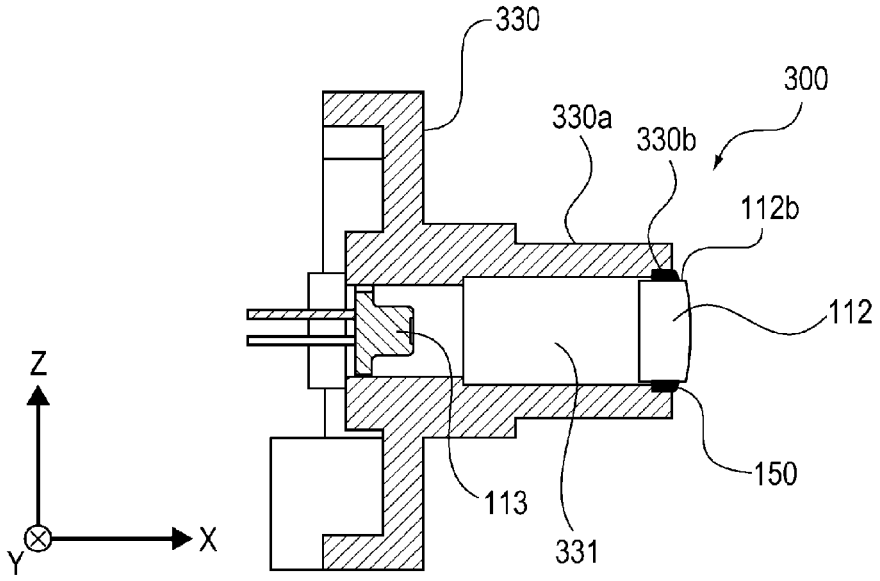
Figure 8:
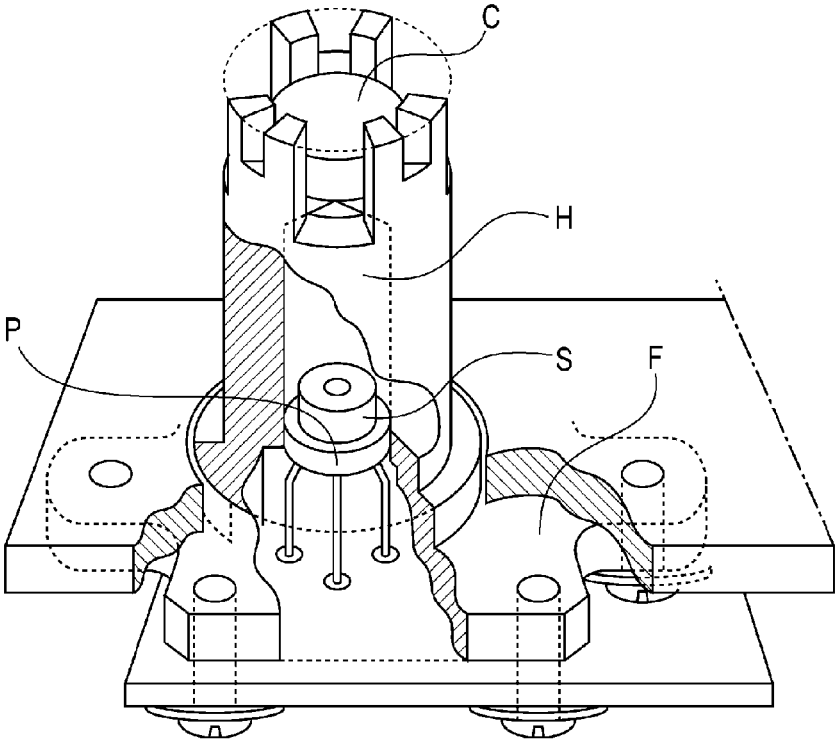
FIG. 8 is a drawing for describing the prior art regarding the structure of a light source device.
Figure 8:
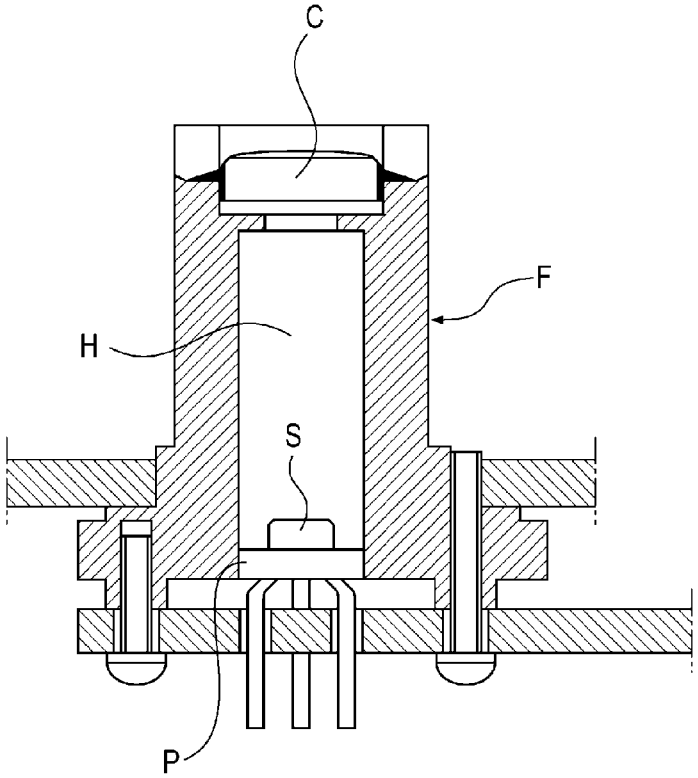

Part (a) of FIG. 7 is a perspective view of a holder 330, which is the second version of the modification of the holder 130 in the first embodiment. Part (b) of FIG. 7 is a sectional view of the holder 330 at a plane c-c in part (a) of FIG. 6. By the way, part (a) of FIG. 7 shows the holder 330 prior to the attachment of the collimator lens 112 to the holder 230 with the use of adhesive, whereas part (b) of FIG. 7 shows the light source device 300 after the attachment of the collimator lens 112 to the holder 330 with the use of adhesive, for the sake of making it easier to describe the holder 330.

Referring to part (a) of FIG. 7, the holder 330 has: a main portion 330*a* which has a cylindrical portion 331; and an adhesive application surface 330*b*, which opposes the lateral surface 112*b* (surface other than surfaces through which laser light passes) of the collimator lens 112.

The method used to attach the collimator lens 112 to the holder 330 with the use of adhesive is as follows: First, the entirety of the adhesive application surface 330*b* is coated with the adhesive 150, and then, the collimator lens 112 is positioned so that its lateral surface is placed in contact with the adhesive 150. With the use of this method, the gap between the holder 330 and collimator lens 112 is filled with the adhesive 150. Therefore, the only openings which connect the outside of the holder 330 and the internal space of the cylindrical portion 331 of the holder 330 are the gaps left between the holder 330 and the stem 122 of the semiconductor laser 113 by the recesses 123 of the stem 122.

Therefore, it is unlikely for an air flow to occur between the ambient air of the holder 330 and the internal space of the cylindrical portion 331 of the holder 330. Therefore, the holder 330 can reduce the risk that dust particles and the like enter the internal space of the cylindrical portion 331 of the holder 330, and cause image defects by adhering to the semiconductor laser 113.

By the way, in a case where the holder 330, which is the second version of the modification of the holder 130 in the first embodiment, is used, it may be after the positional relationship between the collimator lens 112 and semiconductor laser 113 is adjusted that the gap between the lateral surface 112*b* of the collimator lens 112 and the adhesive application surface 330*b* is filled with the adhesive 150. According to the present invention, the collimator lens 112 is adhered to the holder across the entirety of its circumference. Therefore, there is virtually no gap between the lens and holder. Therefore, it is possible to prevent the occurrence of an air flow. Therefore, it is possible to reduce the occurrence of the image defects attributable to the adhesion of foreign substances to the laser.

Further, the lens is attached to the holder with the use of adhesive, with no direct contact between the lens and holder. Therefore, the lens is movable in the direction parallel to the optical axis of laser light and other directions. Therefore, it is possible to highly precisely focus the beam of laser light emitted from the laser.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-181678 filed on Sep. 15, 2015, which is hereby incorporated by reference herein in its entirety.

What is claimed is:

1. A light source device comprising:

a light source configured to emit a laser beam;

a lens through which the laser beam emitted from said light source passes; and a holder member for holding said light source and said lens;

wherein said holder member is provided with an opening through which the laser beam is outputted, wherein said lens is bonded with said holder member at whole circumference of said opening by an adhesive material without contact with said holder member, and wherein said holder member includes a bonding surface at a side opposing an incident surface of said lens onto which the laser beam is incident, and a projection projecting beyond said bonding surface in a laser optical axis direction, said projection being provided with the opening at a center portion thereof, and wherein the adhesive material is applied on said bonding surface outside said projection with respect to a radial direction from a center of said opening.

2. A light source device according to claim 1, wherein said holder member includes a bonding surface at a side opposing an incident surface of said lens onto which the laser beam is incident, an annular groove in the bonding surface, and a groove crossing with and continuous with said annular groove.

3. An apparatus according to claim 1, wherein said holder member includes a bonding surface at a side opposing a surface other than a laser beam transmission surface of said lens, and said adhesive material is applied between said bonding surface and said lens.

4. A scanning optical apparatus comprising:

a light source device according to claim 1; and scanning means for scanning a surface to be scanned with the laser beam emitted from said light source device.

5. An image forming apparatus comprising:

a photosensitive member;

a scanning optical device according to claim 4 configured to scan said photosensitive member with a laser beam modulated in accordance with image information to form an electrostatic latent image on said photosensitive member;

a developing portion configured to develop the electrostatic latent image with toner into a toner image; and a transfer portion configured to transfer the toner image from said photosensitive member onto a recording material.

6. A light source device comprising:

a light source configured to emit a laser beam;

a lens through which the laser beam emitted from said light source passes; and a holder member for holding said light source and said lens;

wherein said holder member is provided with an opening through which the laser beam is outputted, wherein said lens is bonded with said holder member at whole circumference of said opening by an adhesive material without contact with said holder member, wherein said holder member includes a bonding surface at a side opposing an incident surface of said lens onto which the laser beam is incident, an annular groove in the bonding surface, and a groove crossing with and continuous with said annular groove.

7. A scanning optical apparatus comprising:

a light source device according to claim 6; and scanning means for scanning a surface to be scanned with the laser beam emitted from said light source device.

8. An image forming apparatus comprising:

a photosensitive member;

a scanning optical device according to claim 7 configured to scan said photosensitive member with a laser beam modulated in accordance with image information to form an electrostatic latent image on said photosensitive member;

a developing portion configured to develop the electrostatic latent image with toner into a toner image; and a transfer portion configured to transfer the toner image from said photosensitive member onto a recording material.

* * * * *